United States Patent [19]

Neward

[11] Patent Number: 4,775,302

[45] Date of Patent: Oct. 4, 1988

[54] HAND-HELD VACUUM AND PRESSURE PUMP

[76] Inventor: Theodore C. Neward, 521 Scripps Dr., Claremont, Calif. 91711

[21] Appl. No.: 904,697

[22] Filed: Sep. 8, 1986

Related U.S. Application Data

[63] Continuation-in-part of Ser. No. 684,338, Dec. 20, 1984, abandoned.

[51] Int. Cl.[4] ..... F04B 41/00; F04B 39/10

[52] U.S. Cl. ..... 417/440; 417/566; 417/569

[58] Field of Search ..... 417/236, 238, 239, 437, 417/440–442, 566, 569, 571

[56] References Cited

U.S. PATENT DOCUMENTS

| | | | |
|---|---|---|---|
| 1,946,166 | 2/1934 | Kovach | 417/238 |
| 1,963,576 | 6/1934 | Boerlage | 417/236 |
| 2,138,605 | 11/1938 | Landis | 417/566 |
| 2,148,929 | 2/1939 | Dalton | 417/440 |
| 2,274,304 | 2/1942 | Perry | 92/194 |
| 2,297,655 | 9/1942 | Koch | 92/194 X |
| 2,491,633 | 12/1949 | Yuza | 417/566 X |
| 2,895,424 | 7/1959 | Tramontini et al. | 417/566 |
| 2,941,854 | 6/1960 | Jernander | 92/194 X |
| 2,973,231 | 2/1961 | Reynolds | 92/194 X |
| 3,612,722 | 10/1971 | Neward | 417/566 X |
| 3,664,774 | 5/1972 | Tupper et al. | 417/571 X |
| 3,824,043 | 7/1974 | Nordell | 417/440 |
| 3,900,276 | 8/1975 | Dilworth | 417/566 X |
| 3,957,399 | 5/1976 | Siczek | 417/388 X |
| 3,961,869 | 6/1976 | Droege, Sr. et al. | 417/566 X |
| 3,981,636 | 9/1976 | Aoki et al. | 417/566 |
| 4,231,724 | 11/1980 | Hope et al. | 417/566 X |
| 4,259,042 | 3/1981 | Heatherly | 417/566 |
| 4,278,114 | 7/1981 | Ruberg | 417/566 X |
| 4,285,641 | 8/1981 | Brimhall | 417/442 |
| 4,565,506 | 1/1986 | Williams | 417/566 X |

FOREIGN PATENT DOCUMENTS

| | | | |
|---|---|---|---|
| 1375871 | 9/1964 | France | 417/566 |
| 312635 | 11/1933 | Italy | 417/440 |
| 389075 | 6/1931 | United Kingdom | 417/566 |

*Primary Examiner*—Carlton R. Croyle
*Assistant Examiner*—Paul F. Neils
*Attorney, Agent, or Firm*—Lyon & Lyon

[57] ABSTRACT

A small and compact vacuum-pressure pump which serves as a portable vacuum-pressure source is disclosed. The pump includes a cylinder coupled with one handle and a piston therein coupled with another handle. A valving means with a rotatable in a cylinder allows either a vacuum or pressure to be created at a port to the valving means. The valving means which is located ahead of an inlet valve to the cylinder can adapt a preexisting vacuum pump to operate either as a vacuum pump or a pressure pump as required.

18 Claims, 1 Drawing Sheet

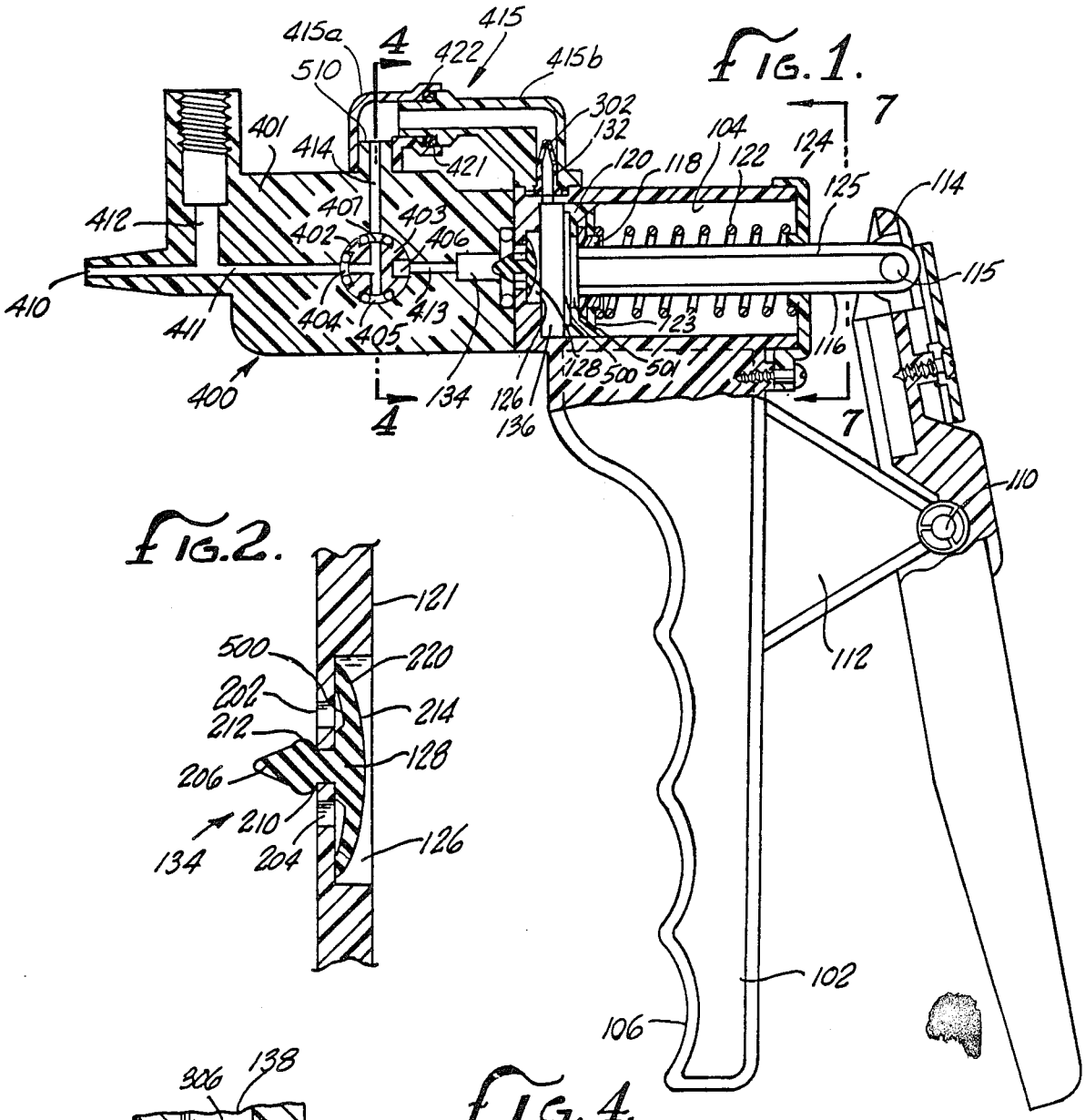
FIG. 1.
FIG. 2.
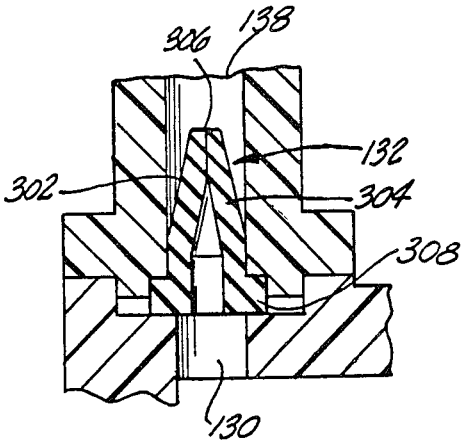
FIG. 3.
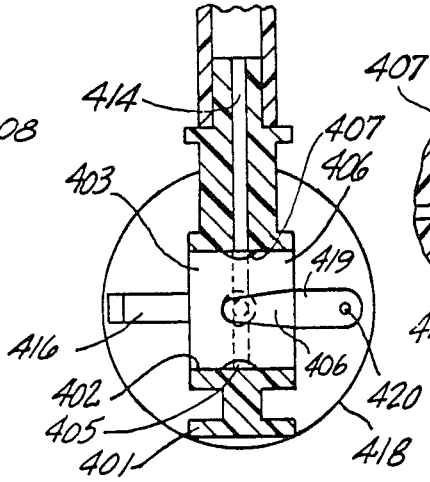
FIG. 4.
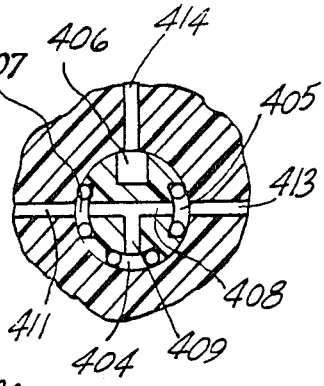
FIG. 5.

HAND-HELD VACUUM AND PRESSURE PUMP

BACKGROUND OF THE INVENTION

Related Application

This application is a continuation-in-part of Ser. No. 684,338 filed Dec. 20, 1984, and now abandoned. The application is also associated with a co-pending application Ser. No. 903,959 filed Sept. 5, 1986, The contents of those applications are incorporated by reference herein.

Field of the Invention

The present invention relates to the field of hand-held vacuum and pressure pumps. It is a novel and useful improvement on the device disclosed in U.S. Pat. No. 3,612,722 issued to Theodore C. Neward.

Vacuum pumps are generally useful whenever a vacuum is desired, for example, to provide suction. Many types of vacuum pumps have been devised, but they often suffer from such drawbacks as complexity, expense, or excessive bulk. Accordingly, there is a need for a simple, inexpensive, lightweight, and compact hand-portable vacuum pump which can pull a useful vacuum, such as the vacuum pump of the present invention.

Hand-held and inexpensive vacuum pumps are especially useful in the automotive industry for vacuum system testing and repair, and for liquid sampling. They are also useful in some first aid applications, for testing for throat blockage of choking victims and for generating suction to eliminate any blockage.

U.S. Pat. No. 3,612,722 (Neward) discloses a hand-held vacuum pump, and is incorporated herein by reference.

The present invention provides a pump and adapter which can produce a vacuum and/or pressure and which lends the pump to a wider range of potential uses. The pump can be used to provide a pressure of about two atmospheres for applications requiring air pressure. The present invention also improves on the prior art in that it is more resistant to dirt, contaminating fluids, and other foreign objects which may cause damage. This makes the new vacuum and pressure pump more reliable, a quality which is most desired in many environments.

Further, the present invention improves on the prior art in that it can be assembled and disassembled faster. This lends the new vacuum and pressure pump to easier and less costly manufacture and to quicker repair which makes the pump more available and more reliable. The present invention also improves on the prior art in that it uses less expensive parts. This reduces the cost of the new pump and makes it more available to quantity purchasers.

It is an object of the present invention to provide an improved hand-held vacuum and pressure pump.

It is a second object of the present invention to produce a hand-held vacuum pump which produces a better vacuum and/or pressure.

A further object of the invention to provide an adapter for retrofitting and changing vacuum pumps which are available thereby to provide for pressure pumping.

It is another object of the present invention to produce a hand-held vacuum and pressure pump which is more resistant to dirt and fluids.

It is a further object of the present invention to produce a hand-held vacuum and pressure pump which can be assembled and disassembled more quickly.

It is also an object of the present invention to produce a hand-held vacuum and pressure pump that is less expensive and that uses less expensive parts.

These and other objects of the present invention will become clear after an examination of the drawings, the description and the claims herein.

SUMMARY OF THE INVENTION

A pump convertible for generating a vacuum or pressure includes a chamber for creating a pressure differential, an inlet and an outlet to the chamber, inlet valve means to the inlet, and outlet valve means to the outlet. Valving means is located between the inlet valve means and the outlet valve means. The valving means is variable, and is connected with a port to the valving means, such that in one position of the valving means the pump differential pressure creates a pressure at the port, and in a second position of the valving means the pump differential pressure creates a vacuum at the port.

The valving means includes an opening movable between a first position whereby air can be drawn into the inlet valve and create a pressure at the port. Alternatively, in a second position air can be exhausted from the outlet valve to the port thereby creating a vacuum at the port.

The valving means is mounted in a body with a connecting conduit for joinder to the outlet valve means from the pump. A plate screwingly connects the valving means body with the pump body at the inlet valve means.

The pressure differential is set up by spring loaded piston being drawn back in a sealed chamber. The inlet valve is an umbrella valve placed at one end of the sealed chamber. Thus, when the piston is drawn back, a partial vacuum is created in the chamber and pressure is equalized by the creation of suction through the umbrella valve. When the spring pushes the piston forward to the end of the sealed chamber, air is released through the valve outlet being a duckbill valve, also placed at the end of the sealed chamber.

SUMMARY OF THE DRAWINGS

FIG. 1 is a cutaway side view of the vacuum-pressure pump with the valving means in the pressure mode, the position being shown in a partially retracted state.

FIG. 2 is a cross-sectional view of the umbrella inlet valve.

FIG. 3 is a cross-sectional view of a duckbill outlet valve.

FIG. 4 is a sectional view from the front of the valving means.

FIG. 5 is a partial sectional side view of the valving means in the vacuum mode.

DETAILED DESCRIPTION

The vacuum-pressure pump includes a fixed handle 102, which is attached to a sealed cylinder 104, and together they form the body of the pump. The fixed handle 102 is shaped to include indentations 106 for the fingers of an operator's hand. A movable handle 108 is pivoted at a joint 110 on a support 112 which is attached to the fixed handle 102. The end of the movable handle 114 is coupled via a joint 115 to a piston rod 116.

The piston rod 116 extends into the cylindrical chamber 104 and terminates in a cylindrical piston cap 118 with a resilient cylindrical piston 120 disposed thereon. The cap 118 and piston 120 are shown slightly drawn back from the inner end 121 of the cylindrical chamber 104. The cap 118 has at its leading end a small disc formation 501 ahead of which is a larger disc formation 500. The piston 120 is pressed to the inner end of the cylinder 104 by a spring 122. One end of the spring 122 bears against a cap 124 secured to the outer end of the cylinder 104, and the other end of the spring 122 bears against a spreader ring 123. The spring 122 thus presses against the back side of the spreader ring 123 which in turn presses against the back side of the piston 120 to thereby improve the seal between the piston 120 and the cylinder 104.

The piston rod 116 may be flat and may have a pair of reinforcing ribs on either side, only one rib 125 is shown in FIG. 1. When the pair of handles 102 and 108 is squeezed, the piston 120 will be drawn back. When the pair of handles is released, the spring 122 will cause the piston 120 to return to the inner end 121 of the cylinder 104.

For pressure pump operability it is necessary that the spring 122 is strengthened over a spring 122 normally operable as only a vacuum pump. Also, to facilitate the generation of a pressure there is located a pressure pad 502 at a location opposite the piston for exerting thumb pressure on the end of the piston to assist in urging its forward movement.

At the inner end of the cylindrical chamber 104 is a first recessed area 126 where an inlet valve means, being an umbrella valve 128 is placed (see FIG. 2). Also at the inner end of the cylindrical chamber 104 is a second recessed area 130 at which an outlet valve means being a duckbill valve 132 is placed (see FIG. 3). The first valve means and the second valve means are separate units. Note that the second recessed area 130 is normal to the axis of the cylindrical chamber. The cylindrical piston 120 can cover and seal this second recessed area 130 when the piston is at that end of the chamber.

When the piston is drawn back, air will be drawn from the pump's inlet area 134 into the area 136 evacuated by piston 120 creating a differential pressure. When the handle is released and the spring loaded piston 120 returns to the inner end 121 of the cylindrical chamber 104 the air in the cylinder's evacuated area 136 will be forced to exit via the duckbill valve 132 to the pump's exhaust area 138. It can be easily seen that repeated squeezings and releasings of the two handles 102 and 108 will result in air being pumped from the inlet area 134 to the outlet area 138, and a high vacuum will be generated. In addition, pressure will be generated through the exhaust area 138.

The valving means 400 is disposed in a valving body 401 which converts the pump between a vacuum pump and a pressure pump. The valving body 401 includes a cylindrical formation 402 wherein there is a rotatable rotor 403 with four circumferentially disposed and spaced apertures 404, 405, 406, and 407 located at substantially right angular spacing from each other. Apertures 405 and 407 are connected by a tube 408 and is also connected with aperture 404 by a pipe 409. Aperture or opening 406 is open to the air and is not connected to any of the other apertures 404, 405 and 407.

The forward end of the valving body 401 is connected with a port 410 through which the differential pressure is used so that either a vacuum is drawn or a pressure created. The port 410 is connected by tube 411 with the cylinder formation 402. A branch tube 412 from the tube 411 permits for connection to a vacuum and/or pressure gauge as required.

Also connecting with the cylinder 402 is a tube 413 connected to the input to the umbrella valve inlet, and a tube 414 to a second port 510 connected by a conduit 415 with the duckbill valve outlet.

Operation of the valving means 400 is through the rotor 403 and an axial handle or finger grip 416 whereby the rotor 403 can be rotated and positioned positioned in either the vacuum position or the pressure position.

The valving body has a I-piece cross-sectional structure as best seen in FIG. 4, and the end 418 adjacent the pump body has a substantially circular plate 417. There is a support shoulder 419 with apertures 420 through which screw means can affix the valving means body with the pump body.

In the illustration of FIG. 1 the tube 415 is shown as being composed of two sections 415*a*, 415*b* which are effectively joined when the valving body 401 is affixed to the vacuum/pressure pump. The joining can be through a tapered coupling 421 with a suitable o-ring seal 422 to ensure pressure and vaccum can be maintained.

In operation of the pump means as a pressure pump as indicated in FIG. 1 air drawn on through aperture 406, enters tube 413 and though the umbrella valve into the cylinder. From there it passes through duckbill valve when the piston is returned under spring pressure, to the tube conduit 415. In turn it enters aperture 407 and passes through conduits 408 and 409 to aperture 404 and in turn along tube 411 to port 410.

As a vacuum pump the air is drawn through port 410 to tube 411, and with the valving rotor 403 in the position shown in FIG. 5 it passes through tube 408 to tube 413, as the piston is drawn back in its cylinder. When the piston is returned, it pumps air through the duckbill valve, conduit 415, tube 414 and exits through aperture 406. This causes a vacuum to be drawn at port 410.

Referring now to FIG. 2, the operation of an umbrella valve is disclosed.

The umbrella valve 128 operates in conjunction with a pair of air inlets 202 and 204. It comprises a rubber plug 206 (which may be made of polyfluorosilicone), which is inserted through its retaining wall 208 at a plug-hole 210 and which is thickened at a section 212 to prevent it from falling through the plug-hole 210. Valve 128 also comprises a broad gas shield 214 which covers the air inlets 202 and 204 and which is impermeable to gases. The gas shield is flexible but has some tension, so that gas flow may occur from the inlet area 134 (FIG. 1), through the air inlets 202 and 204, past an edge 220 of the gas shield 214 to the other side of the gas shield shown as area 136. When the air pressure of inlet 134 exceeds that of area 136, gas flow will occur. However, when this air pressure differential is reversed, no gas flow will occur.

An umbrella valve is a standard device and is well-known in the art.

Referring now to FIG. 3, the operation of a duckbill valve is disclosed.

The duckbill valve 132 comprises a pair of solid, flexible walls 302 and 304 (which may be made of polyfluorosilicone) and which are compressed together at a lip 306. The valve 132 is anchored with a solid base 308 connected to the solid walls 302 and 304. The walls terminate in a lip 306 which is flexible but which has some tension, so that gas flow may occur from the inside area 130 to the outside areas 138 of the valve 132.

When the air pressure of area 130 exceeds that of area 138, gas flow will occur from area 130 to area 138, but when the air pressure differential is reversed, no gas flow will occur.

A duckbill valve is a standard device and is well known in the art.

The valving body 400 can be affixed through a retrofit to a vacuum pump thereby adapting the vacuum pump into a vacuumpressure pump as required.

The components are conveniently made of plastic and are easily repairable. The pressure attainable are as high as 25-30 p.s.i. depending on the spring pressure.

It should be understood that while a presently preferred embodiment has been disclosed, variations are possible which remain within the scope of the present invention.

What is claimed is:

1. A hand held-pump, comprising, (a) cylinder means and having an inlet opening and an outlet opening, (b) biased piston means, for creating a pressure differential and for drawing air through the inlet opening of the cylinder means when said biased piston means is drawn back, and for automatically returning said piston means to the end of said cylinder means when said piston means is no longer drawn back, (c) inlet valve means coupled with the inlet opening of the cylinder means, and outlet valve means coupled with the outlet opening of the cylinder means, (d) hand operated piston retractor means for drawing said piston means back within said cylinder means, whereby drawing said piston means back causes air to be drawn into said cylinder means via the inlet opening of the cylinder means, and whereby releasing said piston retractor means causes air which was drawn in to be forced out via the outlet opening of said cylinder means, and (e) valving means between the inlet valve means and the outlet valve means, and having a port to the valving means, said valving means having an opening movable between a first position in communication with the inlet valve means whereby air can be drawn into the inlet valve means to create a pressure at the port and the pump acts as a pressure pump, and a second position in communication with the outlet valve means whereby air can be exhausted from the outlet valve means to the port thereby creating a vacuum at the port and the pump acts as a vacuum pump, said valving means including circumferentially spaced apertures, three of the apertures being interconnected and a fourth constituting the opening.

2. A pump as claimed in claim 1 wherein in the second position connection of one of the apertures with the port and another aperture with the inlet valve means creates a vacuum pump, and wherein in the first position connection of one of the apertures with the outlet valve means and another aperture with the port creates a pressure pump.

3. A pump a claimed in claim 2 wherein the apertures are located about a rotor rotatable in a cylinder formation, the rotor being movable by an axially directed handle.

4. A pump as claimed in claim 3 including a conduit connecting the outlet valve means to the valving means through a second port.

5. A pump as claimed in claim 4 wherein the outlet valve means is a duckbill valve.

6. A pump as claimed in claim 17 wherein the conduit includes two sections effectively joinable in sealing engagement, the two sections being joined through mating tapered formations and a sealing ring extending between the sections.

7. A pump as claimed in claim 4, including means for manually assisting the piston to return to its position at the end of the cylinder.

8. A pump as claimed in claim 4 wherein the inlet valve means is an umbrella valve.

9. A pump as claimed in claim 8 wherein the outlet valve means is a duckbill valve.

10. A pump as claimed in claim 9 wherein the valving means is removably affixed through a mating plate to an end of the cylinder means.

11. An adapter for converting a hand-held vacuum pump to be convertible between either a vacuum pump or a pressure pump, said vacuum pump having:

(a) cylinder means and having an inlet opening and an outlet opening, (b) biased piston means for creating a pressure differential and for drawing air through the inlet opening of the cylinder means when said biased piston means is drawn back, and for automatically returning said piston means to the end of said cylinder means when said piston means is no longer drawn back.

(c) inlet valve means coupled with the inlet opening of the cylinder means, and outlet valve means coupled with the outlet opening of the cylinder means, (d) hand operated piston retractor means for drawing said piston means back within said cylinder means, whereby drawing said piston means back causes air to be drawn into said cylinder means via the inlet opening of the cylinder means, and whereby releasing said piston retractor means causes air which was drawn in to be forced out via the outlet opening of said cylinder means, (e) said adapter comprising valving means for location between the inlet valve means and the outlet valve means, having a port to the valving means, the valving means including an opening movable between a first position in communication with the inlet valve means whereby air can be drawn into the inlet valve means to create a pressure at the port and the pump acts as a pressure pump and a second position in communication with the outlet valve means whereby air can be exhausted from the outlet valve means to the port thereby creating a vacuum at the port and the pump acts as a vacuum pump, said valving means including circumferentially spaced apertures, three of the apertures being interconnected and a fourth constituting the opening.

12. An adapter as claimed in claim 11 wherein in the second position of one of the apertures with the port and another aperture with the inlet means creates a vacuum pump, and wherein in the first position connection of one of the apertures with the outlet valve means and another aperture with the port creates a pressure pump.

13. An adapter as claimed in claim 12, wherein the apertures are located about a rotor rotatable in a cylinder formation, the rotor being movable by an axially directed handle.

14. An adapter as claimed in claim 13 wherein the inlet valve means to the pump is an umbrella valve, and the outlet valve means is a duckbill valve.

15. An adapter as claimed in claim 14 including mating plate means for removably affixing the valving means to the cylinder means.

16. An adapter as claimed in claim 13 including a conduit connecting the outlet valve means to the valving means through a second port.

17. An adapter as claimed in claim 16 including mating plate means for removably affixing the valving means to the cylinder means.

18. An adapter as claimed in claim 16, wherein the conduit includes two sections effectively joinable in sealing engagement, the two sections are joined through mating tapered formations and a sealing ring extending between the section.

* * * * *